United States Patent [19]

Eiermann

[11] Patent Number: 4,786,241

[45] Date of Patent: Nov. 22, 1988

[54] RADIAL SEAL OF A ROTARY PISTON ENGINE

[75] Inventor: Dankwart Eiermann, Weissensberg-West, Fed. Rep. of Germany

[73] Assignee: Wankel GmbH, Berlin, Fed. Rep. of Germany

[21] Appl. No.: 90,313

[22] Filed: Aug. 27, 1987

[30] Foreign Application Priority Data

Aug. 27, 1986 [DE] Fed. Rep. of Germany ..... 3629143

[51] Int. Cl.[4] ..... F01C 19/04

[52] U.S. Cl. ..... 418/123

[58] Field of Search ..... 418/112, 113, 122–124

[56] References Cited

U.S. PATENT DOCUMENTS

| | | | |
|---|---|---|---|
| 3,269,369 | 8/1966 | Ehrhardt | 418/123 |
| 3,547,451 | 12/1970 | Milot | 418/122 |
| 3,851,999 | 12/1974 | Bibbens | 418/122 |
| 4,317,648 | 3/1982 | Shimuzu | 418/122 |
| 4,358,259 | 11/1982 | Morita | 418/122 |

FOREIGN PATENT DOCUMENTS

| | | | |
|---|---|---|---|
| 1451879 | 7/1969 | Fed. Rep. of Germany | 418/122 |
| 2427062 | 1/1975 | Fed. Rep. of Germany | 418/123 |
| 1337601 | 10/1962 | France | 418/122 |
| 1424733 | 2/1976 | United Kingdom | 418/123 |

*Primary Examiner*—John J. Vrablik

*Attorney, Agent, or Firm*—Becker & Becker, Inc.

[57] ABSTRACT

A radial seal of a rotary piston engine with trochoidal-shaped casing inner peripheral surfacing and multi-corner piston, with which sealing strips are arranged in radial grooves in the corners of the piston. The sealing strips under pressure of the operating chambers of the rotary piston engine engage against the casing inner peripheral surfacing and respectively against under-pressure-side groove wall configuration. The sealing strip along a radial underside thereof has a narrow, deep groove extending parallel to the sides of the sealing strip. A sheet-metal strip is installed with nominal clearance in this first meshing groove and the sheet-metal strip projects beyond the groove. A groove spring for the sealing strip is inserted or installed in the base of this groove. A further groove is arranged in the base of the groove for the sealing strip and an edge of the sheet-metal strip projecting beyond the sealing strip engages into the further groove and is supported along the base of this further groove against the pressure of the groove spring. The further groove has a groove clearance which equals the groove clearance of the groove for the sealing strip. A sheet-metal strip has a edge-side projections on a side thereof located in the groove thereof and the groove spring is supported against these projections. Alternatively, the groove spring is fastened or secured along a side of the sheet-metal strip located in the groove.

3 Claims, 1 Drawing Sheet

RADIAL SEAL OF A ROTARY PISTON ENGINE

BACKGROUND OF THE INVENTION

1. Field of the Invention

The present invention relates to a radial seal of a rotary piston engine with a trochoidal-shaped housing runway or casing internal surfacing and multi-corner piston, with which sealing strips are arranged in radial grooves in the corners of the piston; these sealing strips, under pressure of the working or operating chambers of the rotary piston engine, engage against the raceway or casing inner surfacing and respectively also engage against the suction side groove wall.

2. Description of the Prior Art

Such sealing strips, especially as located in a piston corner and as considered in piston rotational direction as to the expansion chamber before passage thereof through a dead-center position, are subject to a special stress or strain; in other words, the trailing radial seals of the expansion chamber before passing the dead center position are subject to stress and wear which leads to wear phenomenon or appearance as to the sealing strip crest, arch, dome or apex on the preceding side thereof as well as leading to corresponding wear or material removal along the housing raceway or casing inner surface.

These disadvantages are not so critical with the sealing strip preceding the expansion chamber as a consequence of the small or nominal inclination thereof with respect to the mantel or housing raceway or casing internal surfacing, although otherwise however being equal. The wear phenomenon or appearances could be reduced or avoided by corresponding material matching, when no concern or care has to be taken as to higher cost expenditure, for example for ceramic strips. Thereby however there cannot be prevented an increase of the friction via a striking engagement that is too strong and pressing of the sealing strips against the mantel or housing raceway or casing inner surfacing. Actually, in itself, the friction resistance with rotary piston engines, especially with motors, is smaller or more nominal than with stroke lifting-cylinder machines. This advantageous relationship at higher rotary speeds and load conditions reverses because of the sealing strips engaged or impinged with a pressure that is too high.

The foregoing mentioned problems result moreover primarily with combustion motors, since here the working or operating pressure rises very quickly and namely still in the time in which the sealing strip of the expansion chamber stands or is located in an acute angle to the raceway, runway or inner operating surfacing of the casing of the rotary piston engine. The friction losses take effect and assume significant however respectively according to rise of the working or operating pressures also with compressors.

The force of the pressure gases for pressing into engagement in the groove space is dependent upon the size of the surfaces of the sealing strip toward the groove base. In German Offenlegungsschrift No. 24 27 062 Maddock dated Jan. 2, 1975 there is described a sealing strip that is made more narrow as far as to half the normal width thereof; in other words, the sealing strip is decreased to only one half of the normal thickness in circumferential direction and in order to form a reduced admission surface on its underside lying opposite to the groove base as to the pressure gases. This strip however is constructed L-shaped on the side thereof toward the mantel runway or casing inner surface. The arm of the L shaped strip extending in circumferential direction is located upon the pressure side for a purpose, also effecting or bringing about, that the pressure gases can engage more quickly therebelow or underneath such arm of the sealing strip. The impingement or engagement surface that effects or brings about the pressing of the sealing strip against the mantel raceway or casing inner surfacing accordingly is considerably enlarged, or practically doubled dimensionally. In addition, the sealing strip is unsymmetrical and consequently considered only as a following or only as a preceding seal respectively according to the positioning of the arm of the L relative to the rotational direction in fulfilling the purpose of such sealing strip.

SUMMARY OF THE INVENTION

An object of the present invention in comparison to the foregoing is to reduce the forces pressing into engagement and effective upon the sealing strip in a radial direction. Such reduction of the forces of pressing into engagement is undertaken to the necessary extent for a secure and certain sealing. Purpose thereof is to avoid the wear phenomenon or appearances along the preceding or advancing flank or side of the crest, arch, dome or apex of the sealing strip and along the mantel raceway or casing inner surfacing, most of all however, to avoid the mentioned friction losses.

This object is met and fulfilled with the features of the present invention for the radial seals under consideration.

Via a stoppage, closure, solitary confinement or isolation of the space or chamber of the groove bottom by sheet-steel strips, the sealing strip is engaged or impinged upon with pressure from the groove base only upon the preceding side thereof as engaged against the mantel raceway or casing inner surfacing; the following side thereof in the radial component remains free of pressure with the latter side being located or positioned behind or after the sheet-steel strip in rotational direction. With the piston corner following the expansion chamber there is conversely only a pressure engagement or impingement against the underside of the sealing strip located or positioned following behind or after the sheet-steel strip. The pressure moment effective upon the strip in radial direction via the groove gas. Thus, groove base or bottom can be set or adjusted relatively by selection of the position of the sheet-steel strip. With compressors there is noted that the relationships laterally however are equal.

A further advantage of the present inventive arrangement is that the spring pressing the sealing strip against the mantel raceway or casing inner surfacing is located or positioned in the interior of the sealing strip. The spring is very well protected against entry or access of the hot pressure gas relative thereto, since the sheet-steel strip in the sealing strip has only a very small or nominal clearance which allows the pressure gas to reach the spring only in a small or nominal quantity of volume and furthermore without greater heat content. The groove clearance is offset or displaced in the groove base for the sheet-steel strip to make possible this protection of the spring in the groove thereof.

The most important advantage of the present invention is an essential and important reduction of friction of the sealing strips against the mantel raceway or casing inner surfacing; consequently also at higher rotational speed and/or load, better friction values are attainable than with corresponding lifting-cylinder piston machines, this reduction of friction moreover under all operating conditions results in and brings about a reduced fuel consumption respectively reduced driving or operating energy requirement.

BRIEF DESCRIPTION OF THE DRAWING

This object, and other objects and advantages of the present invention, will appear more clearly from the following specification in conjunction with the accompanying drawing, in which.

Figure 1:
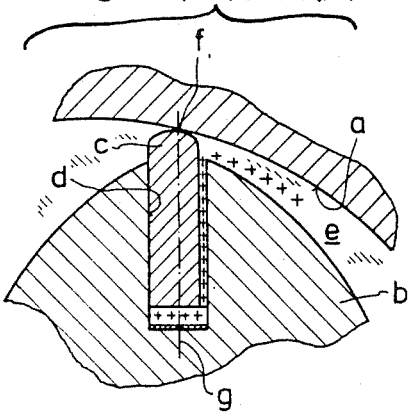
Fig. 1 PRIOR ART
FIG. 1 is a view that shows a partial radial section through a radial seal according to the state of the art.

DESCRIPTION OF PREFERRED EMBODIMENTS in FIG. 1 there is noted that the mantel raceway or inner peripheral surfacing of the casing or housing is designated with a and the piston is designated with b and the sealing strip is designated with c; the sealing strip is located or lies in the groove d. The working or operating chamber designated with e and (to the right in the drawing illustration of FIG. 1) there is located the expansion chamber. The pressure, characterized by a + sign engages the sealing strip c against the suction pressure sidewall of the groove d and presses the sealing strip c from the groove base against the mantel raceway or casing inner peripheral surfacing a against which the sealing strip approaches or runs thereagainst linearly at f. The entire underside of the sealing strip consequently represents the surface engaged or impinged upon with pressure, while it would only be necessary to engage the sealing strip as far as to the line g, of a radial line going straight through f, in order to attain the necessary pressure for sealing-off of the expansion chamber. The pressure of engagement or pressing consequently is more than twice as high, whereby there is added that especially with motors that the pressure rise takes place in sudden bursts. The friction forces are correspondingly higher.

Figure 2:
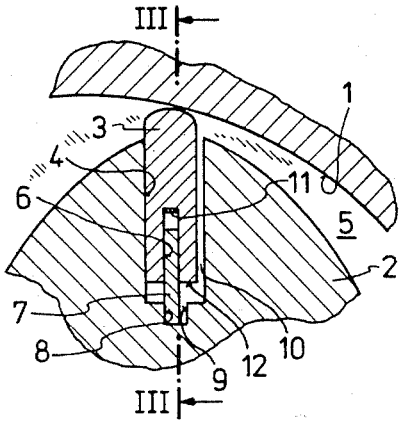
FIG. 2 is a view that shows a corresponding radial section of a present inventive radial seal taken in a plane II—II in FIG. 3.

FIG. 2 shows the present inventive radial seal. FIG. 2 shows the mantel raceway or casing inner surfacing 1 as well as a piston 2 and a sealing strip 3 along with a groove 4 of the sealing strip 3 as well as the expansion chamber 5. The working or operating condition is the same as with the radial seal in FIG. 1. The sealing strip 3 has a narrow and deep groove extending parallel to the sealing strip sides or flanks in radial direction. A sheet-steel strip 7 lies in this groove 6 with small or nominal clearance and the sheet-steel strip 7 projects beyond the underside of the sealing strip 3 in the groove base into a further groove 8 provided therein and supported in the groove base thereof.

This further groove has a clearance 9 relative to or with respect to the sheet-steel strip 7 and this clearance 9 equals the groove clearance 10 of the sealing strip 3.

The groove spring 11, which presses the sealing strip against the mantel raceway or casing inner peripheral surfacing 1 is disposed or offset in the groove 6 between the groove base thereof and the sheet-steel strip 7. The groove spring 11 consequently is no longer exposed or subjected to the hot pressure gases, since the groove 6 has only a very small or nominal clearance, which permits and allows only radial movements of the sealing strip 3, and for that the groove plate 9 for the sheet-steel strip 7 is admitted in the further groove 8.

As a consequence of the blocking or closure, solitary confinement or isolation of the space or chamber in the base of the groove 4 via the sheet-steel strip 7 there is noted that the sealing strip 3 is pressed against the mantel raceway or casing inner peripheral surfacing 1 only along a surface 12 located on the pressure side thereof before the sheet-steel strip 7 by the correspondingly reduced pressure of the working or operating chamber 6.

Figure 3:
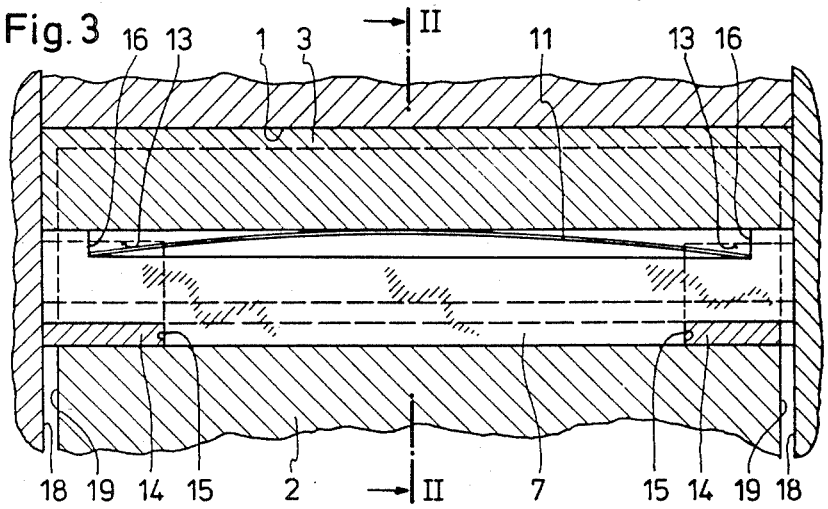
FIG. 3 is a view that shows the radial seal of FIG. 2 in an axial section taken in a plane III—III in FIG. 2.

FIG. 3 shows this arrangement in an axial section. The further groove 8 is milled or cut through the bores 13 for the sealing bolt, peg or pin 14. The sheet-steel strip 7 has corresponding recesses 15 for the sealing bolt, peg or pin 14. The groove spring 11 on the one hand is supported against the edge-side projections 16 of the sheet-steel strip 7 and on the other hand centrally against the base of the groove 6.

Figure 4:
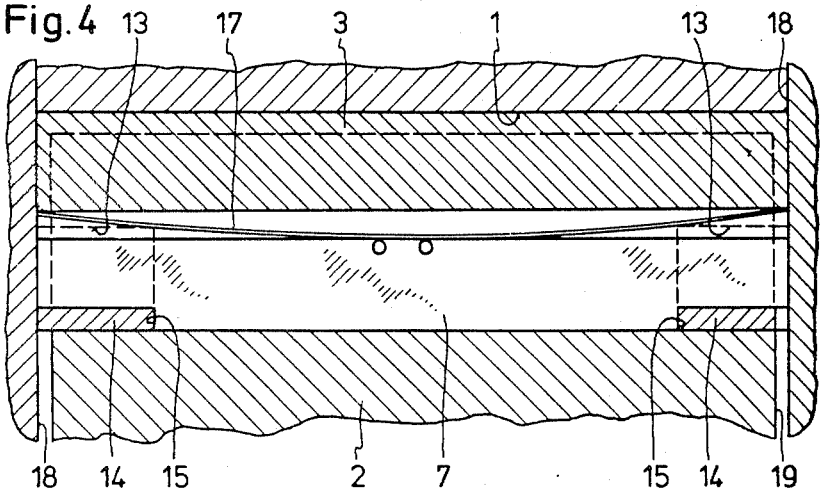
FIG. 4 is a view that shows another embodiment of the present inventive radial seal in an axial section correspondingly in a plane III—III in FIG. 2.

FIG. 4 shows another embodiment with which the groove spring 7 is supported along an edge side against the base of the groove 6 and centrally is fastened to the sheet-steel strip 7.

The housing sidewalls 18 as well as the piston sidewalls 19 are shown in FIGS. 3 and 4.

The embodiments or structural arrangements described are symmetrical. The inventive closure or blocking-off of the groove gas consequently in the same manner is effective with pressure from the preceding or advancing as well as from the subsequent or following working or operating chamber. The application and utilization or employment of the features of the present invention is to be considered possible irrespective and unchanged in any way either with motors as well as with compressors in attaining high compression.

In summary, the present invention provides a radial seal for a rotary piston engine with trochoidal-shaped mantel raceway or casing inner peripheral surfacing and multi-corner piston means, with which in the corners of the piston means in radial groups there are arranged sealing strips which under pressure of the working or operating chambers engage against the mantel raceway or casing inner peripheral surfacing and engaging respectively against the under pressure side groove wall, characterized thereby that the following features are provided:

(1) the sealing strip 3 on a radial underside thereof has a narrow, deep groove 6 extending parallel to the sides or flanks of the sealing strip 3;

(2) a sheet-steel strip 7 is installed or inserted with nominal clearance in this groove 6 and the strip projects beyond the groove 6;

(3) a groove spring 11, 17 is inserted or installed for the sealing strip 3 in the base or bottom of this groove 6;

(4) a further groove 8 is arranged in the base of bottom of the groove 4 for the sealing strip 3 and in this further groove 8 there is engaged the sheet-steel strip 7 having an edge projecting beyond the sealing strip 3 and supported against the base or bottom of this further groove 8 against the pressure of the groove spring 11, 17; and (5) the further groove 8 has a groove clearance which equals the groove clearance of the groove 4 for the sealing strip 3.

The radial strip according to the foregoing has additional characterizing features in that the sheet-steel strip 7 has edge-side projections 16 along a side thereof located in the groove 6 and the groove spring 11 is supported or engaged against these projections.

The radial seal according to the foregoing is further characterized thereby that the groove spring 17 is fastened or secured to the side of the sheet-steel strip 7 located in the groove 6.

The present invention is, of course, in no way restricted to the specific disclosure of the sprcification and drawing, but also encompasses any modifications within the scope of the appended claims.

What I claim is:

1. A radial seal of a rotary piston engine having a trochoidal-shaped inner peripheral surfacing and a multi-corner piston means, with which sealing strips are arranged in radial grooves in corners of the piston means, which sealing strips under the pressure of operating chambers engage against the casing inner peripheral surfacing and respectively engaging against groove wall means on a suction side thereof, the improvement therewith comprising features including:

a sealing strip along a radial underside thereof having a narrow, deep first groove extending parallel to the sides of the sealing strip;

a sheet-metal strip installed with nominal clearance in this first groove, which sheet-metal strip projects beyond the first groove;

a groove spring arranged in that first groove of the sealing strip between said first groove base and that sheet metal strip;

a further groove arranged in the base of the radial groove for the sealing strip, in which a strip of the sheet-metal strip projecting beyond the sealing strip engages and is supported against a base of this further groove against the pressure of the groove spring; and said further groove having a groove clearance which equals the groove clearance of the radial grooves for the sealing strip.

2. A radial seal according to claim 1, in which the sheet-metal strip is provided at each end having an edge lying in the first groove thereof with projections against which said groove spring abuts.

3. A radial seal according to claim 1, in which said groove spring is secured relative to the sheet-metal strip along a side thereof located in the first groove.

* * * * *